United States Patent [19]

Tess

[11] 4,023,727

[45] May 17, 1977

[54] MAILING ENVELOPE STRUCTURE AND METHOD

[75] Inventor: Thomas H. Tess, Green Bay, Wis.

[73] Assignee: Shade Information Systems, Inc., Green Bay, Wis.

[22] Filed: Jan. 26, 1976

[21] Appl. No.: 652,504

[52] U.S. Cl. ..... 229/69; 229/73

[51] Int. Cl.[2] ..... B65D 27/10; B65D 27/06

[58] Field of Search ..... 229/92.1, 92.3, 92.7, 229/73, 69; 282/25

[56] References Cited

UNITED STATES PATENTS

| | | | |
|---|---|---|---|
| 197,678 | 11/1877 | Stevens | 229/92.7 |
| 875,636 | 12/1907 | Tubbs | 229/92.7 |
| 1,167,245 | 1/1916 | Abrams | 229/92.7 |
| 2,004,688 | 6/1935 | Bruce | 229/92.7 |
| 2,340,700 | 2/1944 | Sawdon | 229/73 |
| 2,517,843 | 8/1950 | Cochran | 229/92.1 |
| 3,061,173 | 10/1962 | Sawdon | 229/73 |
| 3,525,469 | 8/1970 | Sawdon | 229/73 |
| 3,618,284 | 11/1971 | Gendron | 229/73 X |
| 3,908,892 | 9/1975 | Pelzer | 229/73 |

*Primary Examiner*—Stephen P. Garbe
*Attorney, Agent, or Firm*—Tilton, Fallon, Lungmus, Chestnut & Hill

[57] ABSTRACT

A mailing envelope structure and method wherein a single sheet is advantageously provided as a business form having a plurality of envelope blanks, each blank being equipped with perpendicular lines of potential folding to divide the blank into four parts, the blank when separated from the business form being divisible into four parts along the lines of potential folding to provide an envelope packet with one part as an invoice or the like and the remaining parts serving as envelope faces both for outgoing and return envelopes.

6 Claims, 20 Drawing Figures

MAILING ENVELOPE STRUCTURE AND METHOD

BACKGROUND AND SUMMARY OF INVENTION:

This invention relates to a mailing envelope structure and method and, more particularly, to an envelope packet which lends itself to the receipt of recipient information at high speed — as in a computer printer.

During the last decade, there has been wide-spread use of computer printers for sending out standardized envelope assemblies wherein individualized information has been applied by the computer printer. Such information may be tax information, university grades, invoicing, etc. For the most part, the mailing pieces employed in this operation have been multiply business forms designated "mailers", i.e., continuous stuffed sealed envelope assemblies. Representative of such mailers in U.S. Pat. No. 3,104,799.

A common usage of such mailers involves five plies or webs of paper, i.e., the front and back of the outgoing envelope, the front and back of the return envelope and the important information ply. Inasmuch as the information ply must be within the outgoing envelope, it is necessary to apply carbon to the inside of the front of the outgoing envelope so that the computer printer can impress the neccesary information relating to the recipient. This, on occasion, has resulted in smudging or other unsightliness. In addition, there is the problem of clarity of register of the printing because of the use of the multi-ply form. Still further, the mailer forms are relatively expensive because of the various operations performed during their manufacture, i.e., collating, cutting, applying adhesive, etc.

The drawbacks of the existing mailers have been avoided by the instant invention which makes use of but a single ply. It permits the achievement of an outgoing envelope, a return envelope, and an information ply or sheet. There is no need for carbonization, hence, no smudging. There is no complicated manufacturing operation, merely printing and possibly slight trimming of a commonplace business form. Lastly, the operations performed for completing the envelope structure may be performed at the site or plant of the party sending out the envelope so that stringent quality control can be maintained.

The structure responsible for this advantageous operation includes as a basic unit a sheet or web of material formed into a generally rectangular blank and having a pair of perpendicular lines of potential folding to divide the blank into four parts. One of the parts serving as an information ply is arranged to expose marginal edge portions of adjacent parts for gluing. The other three parts are available as the fronts and back of the outgoing and return envelopes.

Other details of construction and the method of making and handling as well as other advantages available from the practice of the invention can be seen in the ensuing specification.

DETAILED DESCRIPTION

The invention is described in conjunction with the accompanying drawing, in which.

Figure 1:
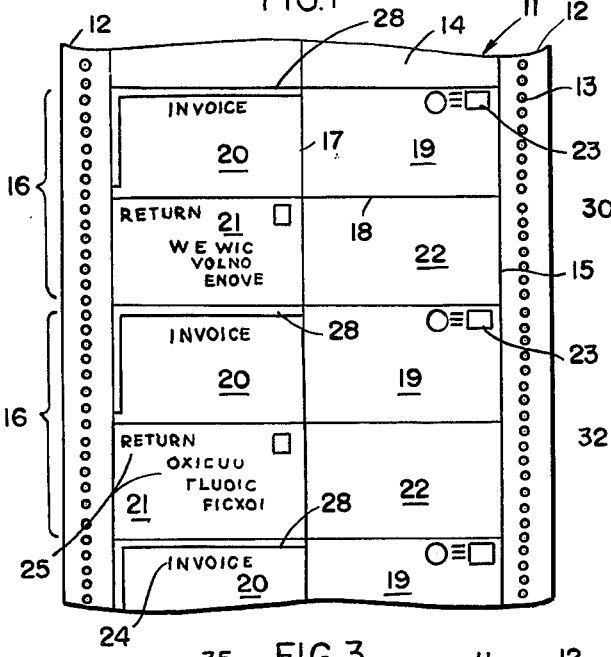
FIG. 1 is a fragmentary elevational view of a business form equipped with indicia and suitably die-cut or trimmed in certan portions to represent an initial stage in the practice of the invention.
Figure 7:
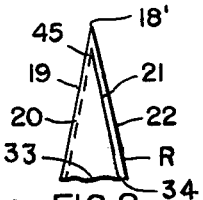
Figure 6:
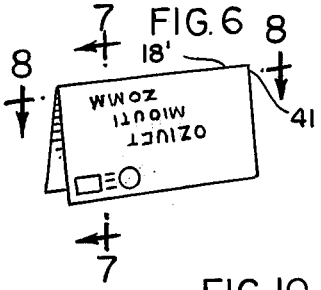
FIG. 6 is a perspective view of the nearly completed envelope, i.e., that resulting from folding along the other line of potential folding.
Figure 8:
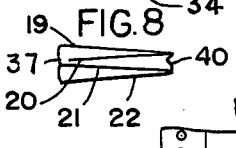
Figure 9:
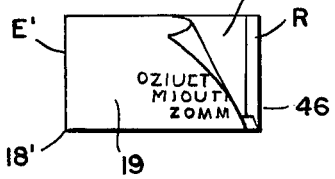
Figure 10:
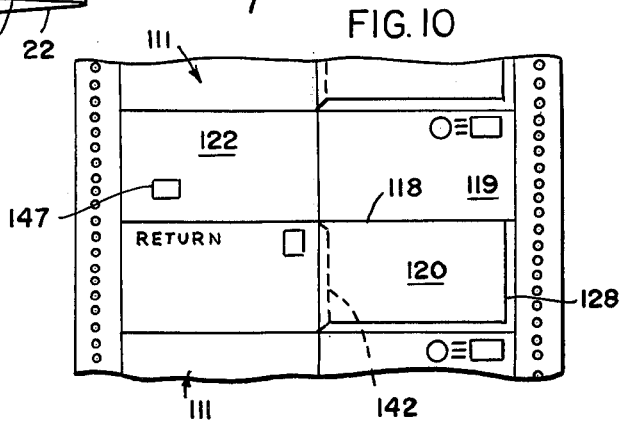
Figure 11:
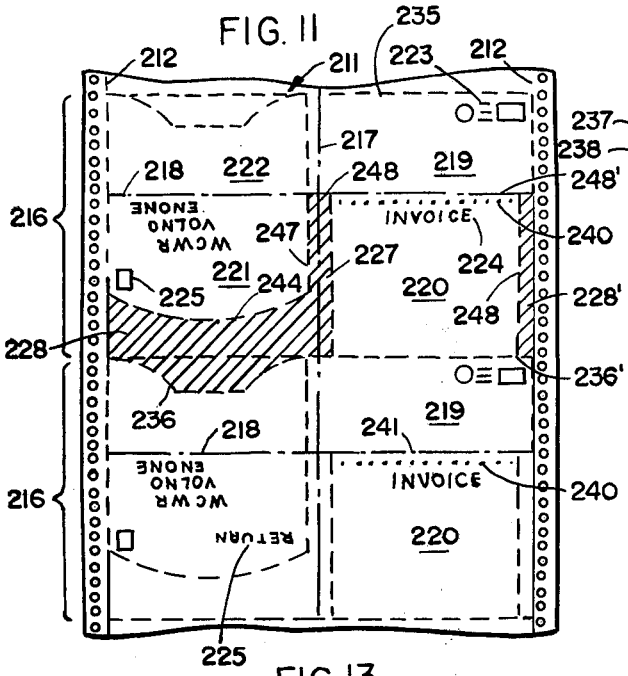
Figure 12:
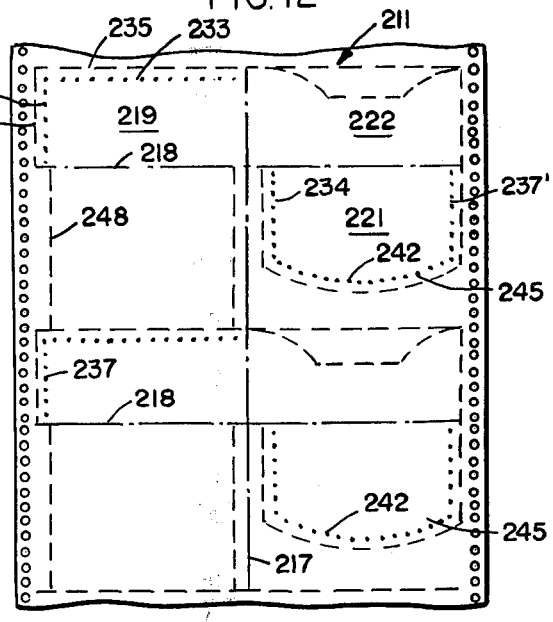
Figure 13:
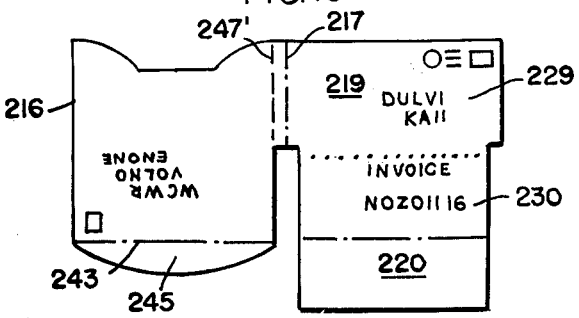
Figure 14:
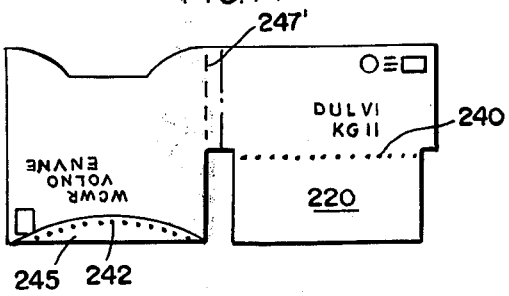
Figure 15:
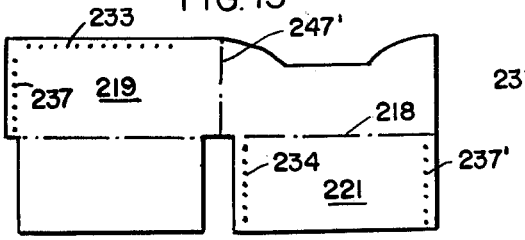
Figure 16:
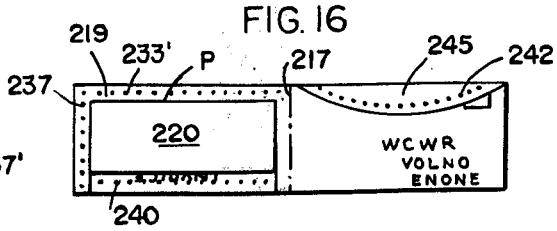
Figure 17:
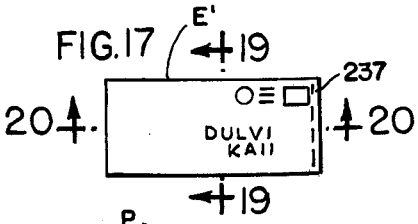
Figure 18:
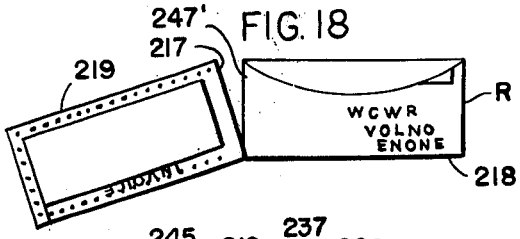
Figure 19:
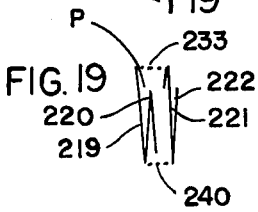
Figure 20:
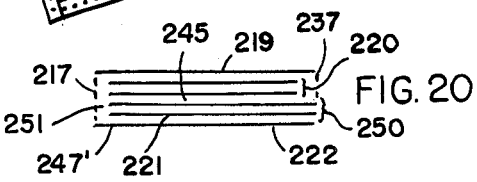

FIGS. 7 and 8 are sectional views taken along the lines 7—7 and 8—8 of FIG. 6;

FIG. 9 is a perspective view of the completed envelope assembly with the front partially pulled back to show the interior;

FIG. 10 is a fragmentary elevational view of a business form embodying a modified form of the invention;

FIG. 11 is a view similar to FIG. 1 but of a modified form of the invention — i.e., fragmentary elevational view of a business form equipped with indicia to represent an initial stage in the practice of the invention;

FIG. 12 is another fragmentary elevational view but of the reverse side of the form seen in FIG. 11;

FIG. 13 is a front elevational view of the trimmed blank resulting from the structure of FIGS. 11 and 12;

FIG. 14 is a view similar to FIG. 13 but with certain parts folded;

FIG. 15 is a rear elevational view of the construction seen in FIG. 14;

FIG. 16 is a view similar to FIG. 15 but showing a subsequent stage in the development of the mailing envelope wherein certain parts are folded;

FIG. 17 is a front elevational view of the completed mailing envelope;

FIG. 18 is an elevational view of the parts of the envelope being separated by the recipient so as to detach the return envelope; and and FIGS. 19 and 20 are sectional views taken along the sight lines 19—19 and 20—20, respectively, as applied to FIG. 17.

Referring now to FIG. 1, the numeral 11 designates generally a business form made up of an elongated or continuous web of paper and equipped with control margins 12 integral with the main web. Each margin 12 is equipped with longitudinally aligned, equally spaced apart line holes or control openings 13. The openings 13 are standard in the business forms industry for engagement by the pins or belts (not shown) for advancing the same through a computer printer or other machine used for the processing of the business form.

Depending upon the technique of the business form producer, the control margins 12 may be made more easily detachable from the main body of the web 14 by means of lines of weakness or perforation 15.

The main body 14 of the business form web 11 has a repeat pattern of blanks 16 — each blank 16 ultimately forming a single envelope unit. Each blank 16 further is characterized by mutually perpendicular lines of potential folding as at 17 and 18 (still referring to FIG. 1). Again, as with the case of the lines of perforation or potential detachment 15, these may or may not be introduced into the web 14, depending upon the technique of the business form producer. In any event, each blank consists of four parts 19, 20, 21 and 22. These may be of equal dimensions, as shown, i.e., quarters.

Each part of quarter 19 of each blank 16, in the illustration given, is intended to be the front of the outgoing envelope as can be appreciated from the imprinted indicia 23 representing a prepaid postage stamping.

The quarter 20, in the illustration given, corresponds to the previously mentioned information ply of a conventional mailer and is effectively identified for that purpose in the drawing by the indicia 24 illustrated by the term INVOICE.

The quarter 21 is intended to be the front of the return envelope and carries indicia 25 in terms of the word "RETURN" to signify its function. The last quarter 22 constitutes the back of both the outgoing and the return envelope, as will be explained in greater detail hereinafter.

Figure 4:
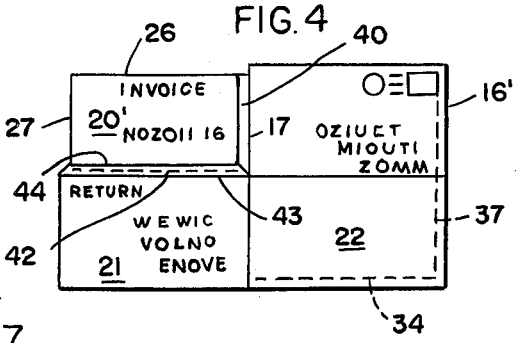
FIG. 4 is a view of the completed blank, i.e., being essentially similar to FIG. 3 but with the control margins removed — the showing in FIG. 4 being of the front or printed side, as contrasted to the reverse side seen in FIG. 3.

Reference is now made to FIG. 4 wherein the separated, cut or trimmed blank is designated by the numeral 16'. In FIG. 4 and specifically relative to the quarter 20', it will be noted that two of the exterior edges as at 26 and 27 have been trimmed. For this purpose each quarter 20 of the blank 16 of FIG. 1 has removed therefrom an L-shaped chip or strip 28. This results in the exposure — after the blank has been folded — of marginal edge portions of an adjacent quarter for gluing or other securememt.

Figure 2:
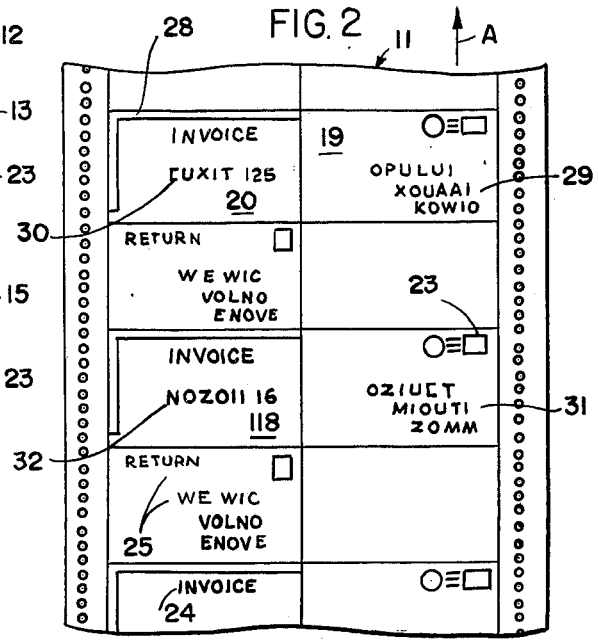
FIG. 2 is a view similar to FIG. 1 but showing the business form after it has been "stepped" through the computer printer and thereby equipped with appropriate recipient information.

However, before separation, gluing and folding, the business form 11 is stepped through the computer-printer werein recipient address information as at 29 in FIG. 2 is applied to the quarter 19. Simultaneously, recipient information indicia as at 30 is imprinted upon the quarter 20. If we assume the business form 11 is moving upwardly as viewed in FIG. 2, in the direction of the arrow A, a subsequent blank will have different recipient address information as at 31 and different invoicing information as at 32, but the same printing as at 23, 24 and 25.

Figure 3:
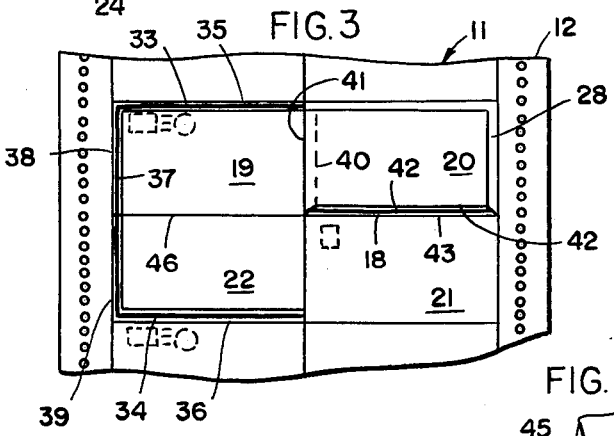
FIG. 3 is a view similar to FIGS. 1 and 2 but showing the reverse side of the business form and differing from the showing in FIG. 2 in having lines of adhesive applied and the flap of the return envelope die-cut.

Once the blank 11 has had the recipient information indicia applied thereto, it is ready for gluing which is indicated in FIG. 3. In FIG. 3, it will be noted that the business form 11 is still equipped with the control margins 12 so that it is readily manipulatible by conventional business form handling machines for the various operations to be performed. It will be appreciated that, depending upon the technique of the business form producer, the chip 28 may be removed at this stage or prior to computer imprinting. If removed after imprinting, the chip 28 may be reeled along with the adjacent control margin 12. The business form 11 is processed through an adhesive remoistening unit (not shown) wherein moisture is applied to transverse bands of adhesive 33 and 34 on the reverse side of the quarters 19 and 22. More particularly, the line of adhesive 33 is positioned adjacent the transverse exterior edge 35 of the quarter 19 and the line of adhesive 34 is positioned adjacent the transverse exterior edge 36 of the quarter 22.

Additionally, two longitudinally extending lines of adhesive are remoistened on each blank. One line of adhesive designated 37 in the left hand portion of FIG. 3 is also positioned on the reverse of the business form and is seen to be adjacent the longitudinal exterior edge 38 of the quarter 19 and also adjacent the longitudinal exterior edge 39 of the quarter 22.

The second longitudinally extending line of adhesive is designated 40 and is shown in dotted line in FIG. 3 representing the fact that it is positioned on the front side of the blank 16 (see the solid line 40 in FIG. 4) and is positioned adjacent one longitudinal interior edge 41 of the quarter 20.

Adhesive 42 is also provided on the reverse of the quarter 20 adjacent the other interior edge 43, i.e., the transverse interior edge (see FIG. 3). A line of severance 44 is generally C-shaped and terminates at the line of potential folding 18 and develops a flap 45 for the return envelope (see particularly FIG. 5) wherein the flap 45 is shown reversely folded.

As can be better appreciated from FIG. 4, the flap 45 is integral with the quarter 21 constituting the front of the return envelope. The line of severance 44 need not be a complete cutting although such is preferred to facilitate the handling of the ultimate envelope by the recipient. Alternatively, the line 44 may be a line of perforation or merely an indication of ultimate severance — again, depending upon the technique employed by the producer or user of the business form 11.

Once the construction of FIG. 4 is achieved, the blank 16' is ready for foldng and mailing. The first fold is performed along the longitudinally extending line of potential folding 17 to develop the structure seen in FIG. 5 wherein the fold line is designed 17'. With the construction seen in FIGS. 1–9, it is necessary that the first fold be along the longitudinal line of potential folding 17. However, in the alternative form of the invention seen in FIG. 10, the initial folding is along the transverse line of potential folding 118. The important feature of folding is to first fold the information quarter 20 against the rear of the outgoing envelope front quarter 19, alternatively, the quarter 120 against the quarter 119.

Figure 5:
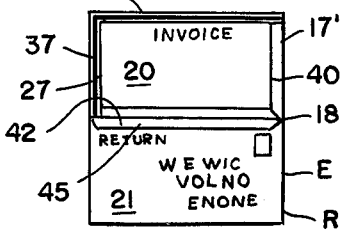
FIG. 5 is a perspective view of the blank of FIG. 4 after the same has been folded along one of the lines of potential folding.

The same act of folding about the line of potential foldng 17 — as represented by the conversion of the blank 16' of FIG. 4 to the partially formed envelope E of FIG. 5, completes the return envelope R. In other words the quarter 22 (see FIG. 4) has been folded under the quarter 21 so as to bring the lines of adhesive 34 and 37 into engagement with the rear side of the quarter 21. However, as seen in FIG. 5, the upper portion of the adhesive line 37 is still exposed, being outboard or exterior of the trimmed edge 27, i.e., being aligned with a portion of the removed L-shaped chip 28. by the same token, the transverse line of adhesive 33 is also exposed and, by virture of the line of adhesive 40 being applied on the "front" side of the quarter 20, it also is exposed.

The last step in the development of the ultimate envelope involves a folding of the upper and lower panels into face-to-face condition as about the line of potential folding 18 (still referring to FIG. 5). FIGS. 6–8 represent an intermediate stage of this final folding step where the fold line is designated 18'. The arrangement of the various quarters or plies can be readily appreciated from a consideration of FIG. 7. At the extreme left of FIG. 7, the front of the outgoing envelope or quarter 19 is seen. Immediately to the right of that is the information ply 20 which is illustrated as unconnected, being only attached to the quarter 19 along the interior edge 41 (also the fold line 17').

Proceeding further to the right in FIG. 7 brings one to the front face 21 of the return envelope (having attached flap 45) and finally to the quarter 22 which is the back of both the outgoing envelope E and the return envelope R. It will be noted that the quarters 2 and 21, i.e., the back and front of the return envelope R are secured by the lines of adhesive 34 and 37 — and that the front of the return envelope 21 by means of the line of adhesive 33 (distorted in FIG. 7 to illustrate the relationship).

In the same fashion in FIG. 8, the four plies 19, 20, 21 and 22 are seen. The plies 20 and 21 are connected adjacent the right hand portion of FIG. 8 by the longitudinally extending line of adhesive 40 while the line of adhesive 37 connects first the longitudinal exterior edges of the quarters 22 and 21 and also the longitudinal exterior edges of the quarters 21 and 19.

When the final envelope E′ (see FIG. 9) is received by the recipient, the same can be readily opened by inserting a letter opener or other device at the corner designated 46. As seen in FIG. 9 wherein the partially opened envelope front part is seen, this step of opening separates the return envelope R from the quarters 19 and 20. In some instances, the fold line 18′ in the portion between the quarters 19 and 22, i.e., the mutual interior edge 46 (see FIG. 3) may be perforated to facilitate opening and detachment. In the same fashion, a line of perforation may be applied along the interior edge 41 which is mutual to the quarters 19 and 20. This facilitates detachment of the invoice should it be desirable to return this invoice 20 in the return envelope R. It will be appreciated that the quarter 20, i.e., the invoice ply, is of smaller dimensions than the return envelope so that the return of the invoice is facilitated. Alternatively, it is possible to correlate the return envelope with a particular invoice by means of identifying indicia applied to the envelope back ply 22 or 122, as the case may be — see the designation 147 in FIG. 10.

The arrangement in FIG. 10 differs essentially from the embodiment in the preceding views in the interchange of positions of the invoice quarter 120 and the envelope back quarter 122. Again, the invoice quarter 120 is trimmed as at 142. However, the return envelope of the FIG. 10 arrangement is "end opening" as contrasted to "top opening" as is the case with the embodiment of FIGS. 1-9. However, in both cases, the fronts of the outgoing and return envelopes, i.e, quarters 19 and 21, are diagonally related in the blank 16, as are the invoice and back envelope quarters 120 and 122 — or 20 and 22, as the case may be.

Turning now to the second sheet of the drawing, and particularly FIG. 11, it will be seen that in the further modified form of the invention, the control margins are designated 212 and that each blank 216 includes an outgoing envelope front 219, an invoice part 220, a return envelope part 221, and an envelope back part 222. Thus, as far as the arrangement of the parts is concerned, the embodiment of FIGS. 11–20 is similar to that of FIG. 10. However, with the embodiment of FIGS. 11–20, a "top opening" return envelope is provided.

The outgoing envelope front part 219 again is equipped with printed indicia 223 at the time the continuous business form 211 is fabricated. In similar fashion, the invoice part 220 is printed as at 224 (still referring to FIG. 11). Still further, the return envelope indicia 225 is applied to the part 221.

In both FIGS. 11 and 12, the lines of potential folding, i.e., the longitudinal line 217 and the transverse line 218 are depicted in chain line fashion, i.e., dot-dash. It will be appreciated, as stated previously, that these lines may be introduced at the time of continuous form fabrication — as by printing, scoring, etc. or developed only at the time the blank has been separated from the form and is ready for mailing.

However, at the time of fabrication of the business from, lines of remoistenable adhesive are laid down — again as pointed out previously. For ease of understanding, these lines are shown as a series of dots in FIGS. 11 and 12. For example, there is provided a line of adhesive 240 on the front face of each form 216 and within the confines of the invoice part 220 adjacent the interior edge 241 separating the invoice part 220 from the front envelope part 219.

On the reverse face of the continuous business form 211, there are provided at the tme of fabrication five lines of adhesive. A first line of adhesive 233 is provided on the rear face of the envelope front part 219 and adjacent the exterior edge 235 (compare FIGS. 3 and 12). A second line of adhesive 237 is also provided on the rear face of part 219 but adjacent the longitudinal exterior edge 238.

The third line of adhesive 237′ is provided adjacent the longitudinal exterior edge of the part 221. A fourth line of adhesive 234 is provided adjacent the longutidinal interior edge of the part 221. Thus, when the part 221 is folded about the line 218 and the adhesive line 234 and 237′ are remoistened, the part 221 engages the part 222 to provide a return envelope — and this will be more apparent subsequently from a consideration of FIGS. 15 and 16.

The fifth line of adhesive is somewhat arcuate in nature and is designated 242 — being on the reverse side of the flap 245.

A series of dashed lines is seen in FIGS. 11 and 12 and these refer to lines of potential severance. For example, and considering the left central portion of FIG. 11, there is seen a shaded area 228 which is bordered by a first line of severance 244, a second line of severance 247, a third line of severance 248 (corresponding to a portion of the fold line 218), a fourth line of severance 227 and a fifth line of severance 236. The last mentioned line of severance 236 is somewhat scoop shaped to develop the usual form of envelope back. However, this is a matter of choice and may be omitted if desired.

Most advantageously, the continuous form 211 is cut along the lines 244, 247, 248, 227 and 236 after issuing from the computer printer — and about the time the various lines of adhesive (with the exception of the flap adhesive 242) have been remoistened. The cutting along these lines of severance develops a chip 228 which remains attached to the left hand control margin 212 (referring to FIG. 11) and thus it is readily reeled for disposal when the control margins 212 are removed.

At this same time, a second chip 228′ (see the right center portion of FIG. 11) is removed. This chip 228′ is defined by a short line of potential severance 236′, a longitudinally extending line 248′, and another short line of potential severance 248′. The chip 228′, after severance from the parts 220 and 219 is also advantageously reeled for diposition with the right hand control margin 212.

Turning now to FIG. 13, the "trimmed" blank 216 is seen. The blank 216 by this time has passed through the computer printer and has had recipient information applied thereto as at 229 and 230. The initial stage for mailing (assuming the blank 216 to have a relatively elongated invoice part 220) involves the folding along a line 243 (see FIG. 13) to turn back the flap 245 and to fold back a portion of the invoice part 220 — the results being seen in FIG. 14. At that time, the line of adhesive 242 is seen on the reverse side of the flap 245 and the line of adhesive 240 on the invoice part 220 is still apparent.

FIG. 15 shows the arrangement of FIG. 14 but from the reverse side. There we see the lines of adhesive 233 and 237 on the reverse face of the outgoing envelope part 219 and the longitudinally extending lines of adhesive 234 and 237′ on the reverse face of the return envelope front 221. Also seen in FIGS. 13–15 is a longitudinally extending line of potential severance 247′ which, in effect, is an extension of the previously mentioned line of potential severance 247. Separation of the parts of the envelope along this line releases the return envelope — this being illustrated in FIG. 18.

Once the assembly of FIGS. 14 and 15 has been achieved, another folding step is performed — this being along the transverse fold line 218 and results in the configuration seen in FIGS. 16. Lastly, the configuration of form seen in FIGS. 16 is folded about the longitudinal line 217 to develop the arrangement seen in FIG. 17. The envelope E′ in FIG. 17 can be appreciated to have a number of superposed plies — this from a consideration of FIGS. 19 and 20.

In FIG. 19, the envelope front part 219 is seen to the extreme left and, to the right of that the folded invoice ply 220. Proceeding further to the right, we encounter the return envelope part or ply 221 and lastly (to the extreme right) the envelope back 222. The return envelope front ply 221 is connected to the outgoing envelope front ply 219 by means of the lines of adhesive 233 and 240 (as seen in FIG. 19 in exaggerated form). The other connections of the front ply 219 are not seen in FIG. 19 — including the intergal connection along the fold line 217 and the line of adhesive 237 (also designated in FIG. 17.)

In FIG. 20 the uppermost ply is the front ply 219 with the next two plies being the invoice ply 220. It will be noted that the invoice plies 220 are narrower than the envelope front ply 219 as can be appreciated from a consideration of the relative width in FIG. 13.

Proceeding downwardly, the next ply encountered is the return envelope flap 245 and thereafter the return envelope front ply 221. The ply 221 is seen to be coextensive with the envelope outgoing front ply 219 at the right hand edge portion as at 250 but spaced inwardly at the left hand portion as at 251. The bottom most ply is the ply 222 which is the envelope back, to both the outgoing and return envelopes. The line of potential severance 247′ is also designated at the lower left hand portion of FIG. 20.

It will be appreciated that the plies 222 and 219 are connected along the left hand edge in FIG. 20 by the integral fold along the line 217. At the right, the plies 219 and 221 are connected by the line of adhesive 237.

The operation of the embodiment of FIGS. 11–20 is essentially the same as that described previously with respect to the embodiments of FIGS. 1–10. The recipient, upon receiving the multi-ply envelope, separates the return envelope R (see FIG. 18) from the outgoing envelope front ply 219 by separation of the adhesive lines 237, 240 and 233. Thereafter, the return envelope R is conveniently detached by separating it from the remaining portion of the envelope packet along the line of severance 247′ which advantageously may be perforated at the time of manufacture. The invoice part 220, being narrower, is advantageously foldable for inclusion in the return envelope.

The invoice part 220 cooperates in another advantageous way with the remainder of the envelope packet. For example, in the configuration of parts illustrated in FIG. 16, the invoice part 220 cooperates with the envelope front ply 219 to provide a pocket P. The pocket P is adapted to receive checks, receipts or the like in the case the user of the computer-printer desires to insert loose material. If the same loose material is desired to be inserted into the pocket P, this can be done on an automatic stuffer. In some instances, it may be advantageous to perforate the continuous business forms 11, 111 or 211 along the various lines of potential severance so as to utilize automatic bursting equipment for separating the blank from the retained control margin 212.

I claim:

1. A mailing envelope structure comprising a generally rectangular web blank having a pair of mutually perpendicular lines of potential folding to divide said blank into four parts and to provide each part with two exterior edges and two interior edges, a first of said parts being equipped with outgoing envelope indicia printed thereon, a second of said parts constituting a recipient information part and being separated from said first part by one of said pair of lines of potential folding, a third of said parts being equipped with return envelope indicia printed theron and being diagonally related to said first part, a fourth of said parts constituting an envelope back separated from said first part by the other of said pair of lines of potential folding whereby when said blank is folded along said one of said pair of potential folding lines, said second part is brought into contacting relation with said first part and said third part is brought into contacting relation with said fourth part, a line of potential severance in said blank for separating said third part from said second part, adhesive means adjacent certain of the edges of at least one of said third and fourth parts ot adhere the same together when in contacting relation to provide a return envelope, and further adhesive means on certain of said first, second and third parts to adhere the first and third parts together when said blank is folded along said other of said pair of lines of potential folding and after said blank has been previously folded along said one line.

2. The structure of claim 1 in which a series of said blanks are provided in interconnected relation as part of an elongated web, said web being equipped with a control margin along each longitudinal edge therof, each control margin being equipped with generally longitudinally space, aligned control openings.

3. The structure of claim 1 in which said third part adjacent an edge thereof is equipped with lines of potential severance to provide a return envelope flap, and adhesive means on said flap.

4. The structure of claim 1 in which said blank is equipped with a line of potential severance for separating said fourth part from said first part and thereby detach said return envelope therefrom.

5. The structure of claim 1 in which said second part adjacent one exterior edge thereof is equipped with a line of potential severance to reduce the size thereof and adapt said first part to be directly adhered to said return envelope.

6. A mailing envelope structure comprising a generally rectangular web blank folded upon two mutually perpendicular lines to form said blank into a four ply, generally rectangular envelope with each ply having four edges and with the edges of the four plies being generally aligned to define first, second, third and fourth edges on both said plies and said envelope, a first of said plies being one outer ply and equipped with outgoing envelope front indicia printed thereon, a second of plies being adjacent said first ply and being integrally connected to said first ply along the first edges thereof and equipped with recipient information indicia printed thereon, a third of said plies being adjacent said second and to a fourth of said plies and being equipped with return envelope front indicia printed thereon, said fourth ply being integrally connected to said third ply along the first edges thereof, said third and second plies being separated adjacent the second edges therof and adhesively secured together along the first edges thereof, and said first and third plies being secured together along the third and fourth edges thereof.

* * * * *